US008809752B2

(12) United States Patent
Yamashita

(10) Patent No.: US 8,809,752 B2
(45) Date of Patent: Aug. 19, 2014

(54) BOOSTER CIRCUIT FOR ENHANCED INDUCTION HEATING UNIT, POWER-SUPPLY UNIT, AND IMAGE FORMING APPARATUS USING THE SAME

(75) Inventor: Tomofumi Yamashita, Takeo (JP)

(73) Assignee: Ricoh Company, Ltd., Tokyo (JP)

( * ) Notice: Subject to any disclaimer, the term of this patent is extended or adjusted under 35 U.S.C. 154(b) by 1134 days.

(21) Appl. No.: 11/688,420

(22) Filed: Mar. 20, 2007

(65) Prior Publication Data

US 2007/0230987 A1 Oct. 4, 2007

(30) Foreign Application Priority Data

Mar. 20, 2006 (JP) ..... 2006-076730
Sep. 22, 2006 (JP) ..... 2006-257588

(51) Int. Cl.
*H05B 6/14* (2006.01)
*G03G 15/00* (2006.01)

(52) U.S. Cl.
USPC ..... 219/619; 219/664; 219/665; 219/624; 219/667; 219/469; 399/88; 399/33; 399/69; 399/150; 399/333

(58) Field of Classification Search
CPC ..... G03G 15/2078; H05B 6/04; H05B 6/062; H05B 6/145
USPC ..... 399/88, 33, 69, 150, 89, 333, 328; 219/664, 665, 624, 619, 667, 469, 216
See application file for complete search history.

(56) References Cited

U.S. PATENT DOCUMENTS

| | | | | |
|---|---|---|---|---|
| 4,392,230 | A | 7/1983 | Keller et al. | |
| 4,556,770 | A * | 12/1985 | Tazima et al. | 219/627 |
| 4,628,284 | A * | 12/1986 | Bruning et al. | 331/86 |
| 4,962,292 | A * | 10/1990 | Aoki | 219/718 |
| 5,847,369 | A * | 12/1998 | Barritt | 219/622 |
| 2002/0051663 | A1 | 5/2002 | Kinouchi et al. | |
| 2002/0158063 | A1 | 10/2002 | Kawase | |
| 2003/0155349 | A1 * | 8/2003 | Matsuo et al. | 219/664 |

(Continued)

FOREIGN PATENT DOCUMENTS

| | | |
|---|---|---|
| CH | 294491 | 11/1953 |
| CN | 1577162 A | 2/2005 |

(Continued)

OTHER PUBLICATIONS

Chinese Office Action issued Mar. 13, 2009, in Chinese Patent Application No. 200710088710.4 (submitting English translation only).

*Primary Examiner* — Dana Ross
*Assistant Examiner* — Ket D Dang
(74) *Attorney, Agent, or Firm* — Oblon, Spivak, McClelland, Maier & Neustadt, L.L.P.

(57) ABSTRACT

A boosting circuit includes a switch element, a first coil, a second coil, and a capacitor. The switch element generates a first alternating current voltage having a first frequency from a direct current voltage. The first coil generates a magnetic field around the first coil with a flow of the first alternating current voltage having the first frequency in the first coil. The first coil also induces an eddy current in the object with the magnetic field to inductively heat the object. The second coil is cumulatively connected to the first coil. The capacitor is connected to the first coil and the second coil in a parallel manner.

11 Claims, 8 Drawing Sheets

(56) References Cited

U.S. PATENT DOCUMENTS

| | | | | |
|---|---|---|---|---|
| 2004/0265021 | A1 | 12/2004 | Kinouchi et al. | |
| 2005/0173417 | A1 * | 8/2005 | Takagi et al. | 219/619 |
| 2006/0062585 | A1 * | 3/2006 | Sone et al. | 399/69 |
| 2006/0198672 | A1 | 9/2006 | Kinouchi et al. | |

FOREIGN PATENT DOCUMENTS

| | | | |
|---|---|---|---|
| DE | 29 38 348 | A1 | 4/1981 |
| JP | 10-127051 | | 5/1998 |
| JP | 2004-266890 | | 9/2004 |

* cited by examiner

BOOSTER CIRCUIT FOR ENHANCED INDUCTION HEATING UNIT, POWER-SUPPLY UNIT, AND IMAGE FORMING APPARATUS USING THE SAME

This application claims priority from Japanese patent applications No. 2006-076730 filed on Mar. 20, 2006 and No. 2006-257588 filed on Sep. 22, 2006 in the Japan Patent Office, the entire contents of each of which are hereby incorporated by reference herein.

BACKGROUND OF THE INVENTION

1. Field of the Invention

The present disclosure generally relates to a booster circuit for boosting a voltage fed to an induction-heating unit for heating an object, and more particularly to a power-supply unit including a booster circuit, and an image forming apparatus including a power-supply unit having a booster circuit.

2. Discussion of the Background

In general, an induction-heating unit (IH unit) may be driven by a commercial power supply such as alternating current (AC).

Such an IH unit may have a protection function that may protect the IH unit from abnormal factors such as a voltage surge due to a lightning strike, for example, momentary power failure, sudden voltage decrease, and sudden voltage increase.

Hereinafter, the induction-heating unit will be termed an "IH unit" for the simplicity of expression, as required.

The IH unit may have a voltage-resonant circuit, which may generate a voltage having a value obtained by multiplying an input voltage by a "Q factor". "Q factor" means "quality factor" (hereinafter referred as "Q factor," as required).

The "Q factor" may be used as an indicator to indicate a performance level of a voltage-resonant circuit.

The "Q factor" can be computed as below with following equations of (1) and (2) with following settings: frequency of voltage-resonant circuit of "$\omega_0$"; coil inductance of "L"; capacitance of capacitor of "C"; and equivalent resistance value of "R" for a circuit.

$$Q=\omega_0 L/R \tag{1}$$

$$Q=(1/R)\times(1/\omega_0 C) \tag{2}$$

For example, in case of a series resonance circuit, a voltage of a coil or capacitor may become a voltage value, which may be obtained by multiplying an input voltage, supplied by a power source, by a "Q factor."

A circuit may have an electronic switch, which may be used for switching a relatively greater power (or electricity).

For example, such an electronic switch may include an "insulated gate bipolar transistor (IGBT)." Hereinafter, the "insulated gate bipolar transistor" may be termed "IGBT" for the simplicity of expression.

FIG. 1 shows an example circuitry of an IGBT, and FIG. 2 shows an example output waveform of each terminal of the IGBT when an electric power of 1,200 W(watt) is input to the IGBT for induction-heating.

The IGBT may be a bipolar transistor, which may include a MOSFET (metal oxide semiconductor field effect transistor) 110 at a gate portion of the IGBT, and has a gate terminal G, a collector terminal C, and an emitter terminal E as shown in FIG. 1.

Such an IGBT can be driven by applying a voltage between the gate terminal G and emitter terminal E, and may have a function of arc-suppressing, in which an ON/OFF switching can be conducted by an input signal. Such an IGBT may be a solid-state device, which can switch a greater power (or electricity).

As shown in FIG. 2, when an input voltage 111 is input to the IGBT, a gate voltage 112 at the gate terminal G and a collector voltage 113 at the collector terminal C may change.

Such an IGBT can switch a relatively greater power (or electricity) compared to a FET (field-effect transistor), but a switching speed of the IGBT may be relatively slower than a switching speed of the FET.

An image forming apparatus may employ an induction-heating unit (IH unit) for fixing an image on a sheet, in which a switching operation may be conducted at a greater power (e.g., dielectric strength of 1,000V and electric current 60 A).

Such switching at greater power cannot be conducted by a FET, which may be used for a normal level of power supply switching. Accordingly, an IGBT may be used for such switching at a greater power (or electricity).

Conventionally, an IH unit may reduce an induction heating time by increasing an induced electromotive force (or electricity).

Increasing a resonance voltage may increase such an induced electromotive force.

A peak value of a resonance voltage (referred to as "resonance peak value") may be increased by changing an inductance component or capacitor component of the IH unit. Such a "resonance peak value" can be increased by reducing a resonance time, in general.

However, an IGBT used as an electronic switch for induction-heating may have an upper limit for switching speed, and thereby, a conventional circuit having the IGBT may not be preferable from a viewpoint of increasing switching speed.

Furthermore, if a switching speed may be increased forcedly in such a conventional circuit, a switching loss of the IGBT may become unfavorably greater.

Furthermore, if a resonance peak value (or Q factor) is increased, a peak value of a waveform may become greater. In such a condition, the Q factor may fluctuate even if a frequency change may occur in a smaller level, which may not be favorable for controlling the IGBT.

FIGS. 3A to 3C show output waveforms of each terminal of an IGBT used for an induction-heating operation.

FIG. 3A shows a condition that a resonance period becomes longer and a resonance is not realized, in which a noise may be generated in a superimposed portion, and a greater loss occurs.

FIG. 3B shows a condition that a resonance is realized, in which an IGBT may be efficiently driven.

FIG. 3C shows a condition that a resonance may be realized, but a resonance period may be shorter and a peak value of the waveform may become higher, in which controlling the IGBT may become difficult. Furthermore, a greater voltage may be applied to a coil, by which a greater heat may be generated, wherein such heat generation may result in a greater loss. Then, an electric current may flow to a body diode of the IGBT, and a greater loss may be observed for a circuit.

As such, in a conventional IH unit, a Q factor may be increased to increase an electromotive force so that a heating speed rate may be increased. In such a condition, a peak value of a resonance waveform may become higher, by which controlling the IGBT may become difficult.

FIG. 4 shows an example block diagram explaining a functional configuration of an induction-heating unit 90.

The induction-heating unit 90 may include an IH cooking heater, for example. Hereinafter, the induction-heating unit 90 may be termed as "IH unit 90" for simplicity of expressions.

The IH unit 90 may have a top plate (not shown) and a heating coil 94 placed under the top plate.

The heating coil 94 may heat a cooking pan 95, which is used as an object to be heated by the IH unit 90. The cooking pan 95 may be made of a metal such as iron, aluminum, stainless steel, or the like.

Such an IH unit 90 may heat the cooking pan 95, which may contain material such as water with an induction-heating method. By heating the cooking pan 95 as such, water in the cooking pan 95 may be warmed or heated.

Furthermore, the IH unit 90 may include a commercial power supply 91, a rectifier 92, and an inverter 93, for example.

When a power supply to the IH unit 90 is set to an ON condition, an alternating current (AC) may flow on the heating coil 94, which may be placed under the top plate.

Such an alternating current (AC) may be a higher frequency wave having a given frequency (e.g., 20 KHz). Such a higher frequency wave of alternating current (AC) may be generated from a direct current by the inverter 93 as below.

For example, the commercial power supply 91 may supply alternating current (AC) having a given frequency and voltage (e.g., 60 Hz or 50 Hz and AC 100V) to the rectifier 92. The rectifier 92 may rectify the alternating current (AC) to direct current (DC), and supply the direct current (DC) to the inverter 93.

The inverter 93 may invert the direct current (DC) to an alternating current (AC) having a higher frequency wave, and may flow the alternating current (AC) to the heating coil 94.

When such an alternating current (AC) may flow in the heating coil 94, a magnetic field may be generated around the heating coil 94.

Such a magnetic field may induce an electric current called an "eddy current" on the cooking pan 95 placed over the heating coil 94.

If a direct current (DC) flows in the heating coil 94, such an eddy current may be generated to the cooking pan 95 for a moment when a DC power supply is set to ON.

The eddy current may result into a heat energy measured as joule heat, which may be energy loss. Another energy loss such as hysteresis loss may occur but such energy loss may be practically ignored.

Such an eddy current may have a flow direction, which may be opposite to a flow direction of an electric current flowing in the heating coil 94.

The eddy current may generate heat energy in an object (e.g., the bottom of the cooking pan 95) to heat the cooking pan 95 with the heat energy. Accordingly, an object (e.g., the bottom of the cooking pan 95) may be directly heated by an induction heating method.

A heating value "W" for such induction heating can be computed as below.

$$W=I^2\times R$$

wherein "I" represents an eddy current, and "R" represents an electrical resistivity of the bottom of the cooking pan 95.

If the cooking pan 95 has water therein, the cooking pan 95 heated by such heat energy may transfer the heat energy to water in the cooking pan 95, by which water in the cooking pan 95 may be warmed or heated to hot water.

Furthermore, such an induction heating unit may be employed for an office automation (OA) apparatus.

A conventional image forming apparatus (e.g., copier) may employ a halogen heater for a toner fixing process.

However, a recently marketed image forming apparatus may have employed the above-explained induction heating unit, by which a temperature control for a toner fixing process may be more precisely conducted, and a warming-up time may be shortened, and thereby, such an induction heating unit may be effective for reducing energy consumption of an image forming apparatus.

FIG. 5 shows a block diagram of an IH unit 1A having a conventional configuration.

The IH unit 1A may be operated as below when conducting an induction-heating operation.

(1) A commercial power supply 4 may supply an AC 100V (as a commercial voltage) to a rectifying circuit 2, and the rectifying circuit 2 directly rectifies AC 100V to DC 141V.

(2) An inverter circuit 3A having an induction-heating (IH) controller 6 (as a microcomputer) and a drive circuit 7 may convert the DC 141V to a higher frequency wave having $600V_{0\text{-}p}$, $50\ A_{0\text{-}p}$, and 20 KHz to 40 KHz.

(3) The inverter circuit 3A may include an IGBT 5 as a switching device (or element), which can conduct a switching operation for a greater power (or electricity).

(4) The IH controller 6 may control an ON/OFF operation of the IGBT 5 with the drive circuit 7.

(5) The above-mentioned operation at (4) may be a voltage resonance operation.

(6) The inverter circuit 3A may include a diode D1 as a body diode for the IGBT 5.

(7) The IH controller 6 may control an induction heating operation, and also control a resonance point tracking, electric current protection, and voltage protection.

Hereinafter, a physical phenomenon of induction heating is explained with reference to FIG. 6, which shows the fundamentals of induction heating.

(1) When a power supply 101 supplies alternating current (AC) to a coil 100, an electric current may flow in the coil 100, and the current may generate a magnetic field MF around the coil 100.

(2) Such a magnetic field MF may also exist around a metal cylinder 102 used as an electric conductor, which is an object placed inside the coil 100.

(3) Then, an electric current called an "eddy current EC" may flow in the metal cylinder 102 in a given direction to cancel an effect of the magnetic field MF. The eddy current EC may flow in a sub-surface portion, having a depth δ, of the metal cylinder 102.

In general, an electric current density may become greater as the electric current gets closer to a surface of an electric conductor (e.g., metal cylinder 102) and may become smaller as the electric current gets further away from the surface of an electric conductor, wherein such a phenomenon may be called as "skin effect."

The higher the frequency of the electric current, the higher the electric current density at the surface, and a higher electric current density may increase an impedance of an electric conductor.

(4) The eddy current EC and an electric resistivity of the metal cylinder 102 may generate a joule heat in the metal cylinder 102. Because the metal cylinder 102 may have more electric current in its surface portion, the surface of the metal cylinder 102 may be heated to a greater level.

(5) With such a process, a temperature on the surface of the metal cylinder 102 may be increased, and also heat dissipation from the metal cylinder 102 may occur concurrently.

(6) A heat transfer may occur from the surface to core portion of metal cylinder 102, by which the core portion of metal cylinder 102 may be heated after the surface of metal cylinder 102 is heated.

SUMMARY OF THE INVENTION

The present disclosure relates to a boosting circuit including a switch element, a first coil, a second coil, and a capacitor. The switch element generates a first alternating current voltage having a first frequency from a direct current voltage. The first coil generates a magnetic field around the first coil with a flow of the first alternating current voltage having the first frequency in the first coil. The first coil also induces an eddy current in the object with the magnetic field to inductively heat the object. The second coil is cumulatively connected to the first coil. The capacitor is connected to the first coil and the second coil in a parallel manner.

The present disclosure also relates to a power unit for heating an object including a power source and a boosting circuit. The power source generates the direct current voltage. The boosting circuit receives the direct current voltage generated by the power source.

The present disclosure also relates to a power unit for heating an object including a rectifying circuit and a boosting circuit. The rectifying circuit rectifies a second alternating current voltage to the direct current voltage. The boosting circuit receives the direct current voltage rectified by the rectifying circuit.

The present disclosure also relates to an image forming apparatus including a fixing member and a power unit. The fixing member fixes an un-fixed image, formed of image developer, on a recording medium. The power unit heats the fixing member inductively.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIGS. 10A and 10B show example waveform charts of a LC resonance circuit, in which FIG. 10A shows an impedance change of a coil with respect to frequency, and FIG. 10B shows a change of quality factor with respect to frequency;

Figure 1:
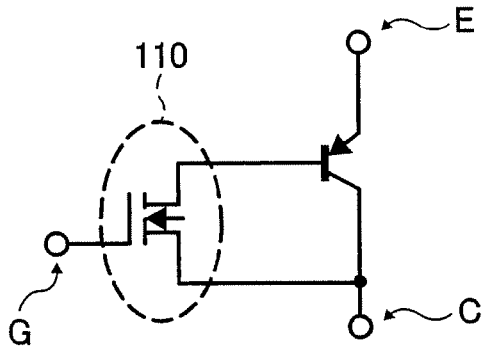
FIG. 1 shows an example circuitry of an IGBT.
Figure 2:
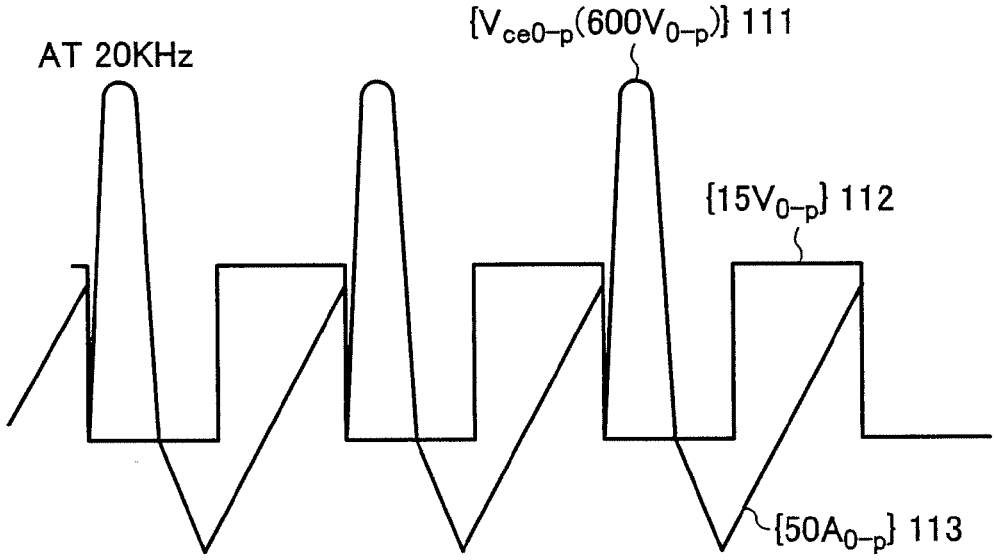
FIG. 2 shows an example output waveform of each terminal of an IGBT when an electric power is input to the IGBT for an induction heating operation.
Figure 3A:
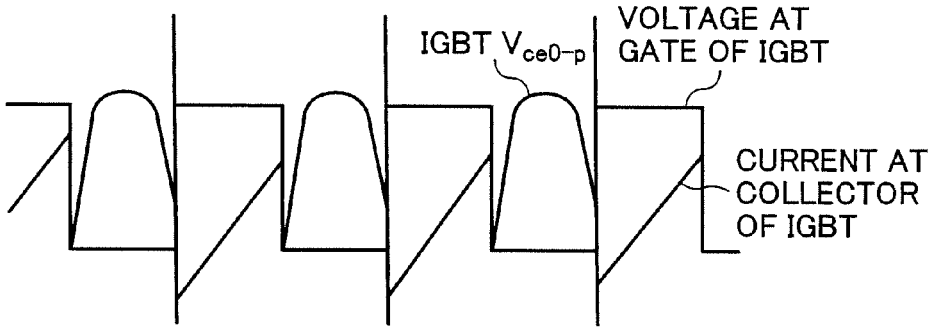
FIGS. 3A to 3C show output waveforms of each terminal of an IGBT used for an induction-heating operation in given conditions.
Figure 3B:
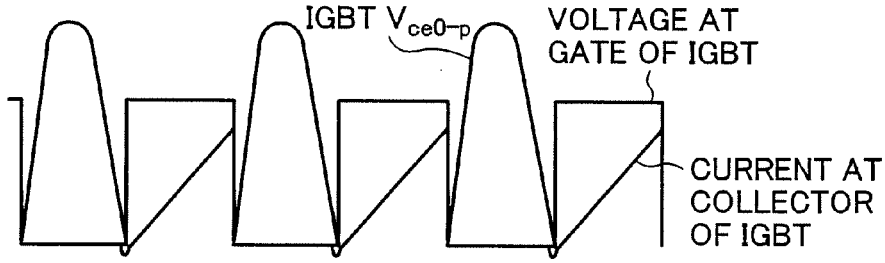
Figure 3C:
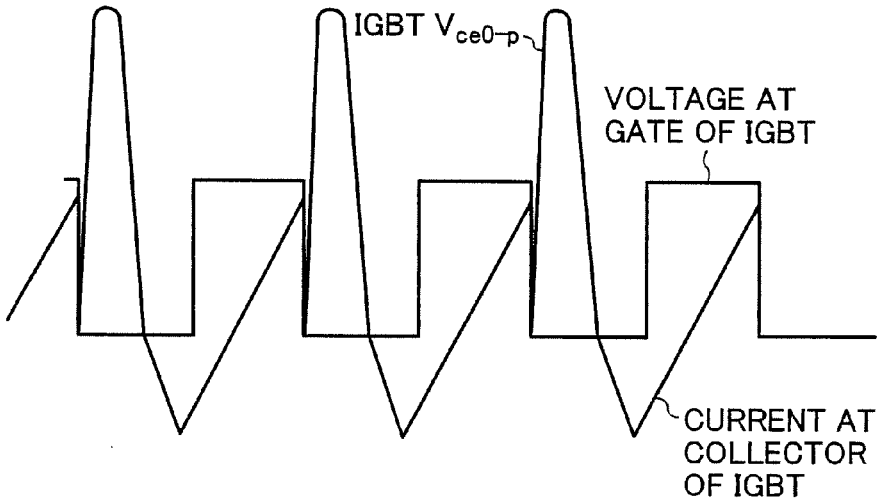

The accompanying drawings are intended to depict exemplary embodiments and should not be interpreted to limit the scope of the present invention. The accompanying drawings are not to be considered as drawn to scale unless explicitly noted.

DETAILED DESCRIPTION OF EXEMPLARY EMBODIMENTS

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present.

Like numbers refer to like elements throughout. As used herein, the term "and/or" includes any and all combinations of one or more of the associated listed items.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, a term such as "below" can encompass both an orientation of above and below. The device may be otherwise oriented (rotated 90 degrees or at other orientations) and the spatially relative descriptors used herein interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular exemplary embodiments only and is not intended to be limiting of the present invention. As used herein, the singular forms "a," "an" and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

The term "quasi-higher frequency" is used hereinafter to describe that the frequency of the AC current generated from the DC current (the first frequency) is higher than the frequency of the AC current (the second frequency) from which the DC current is generated. While the second AC current generally has a sinusoidal waveform, the first AC current generally has a different shape, in particular a rectangular shape, i.e. has higher harmonics in addition to the sinusoidal waveform. In particular, the frequency of the basic sine wave of the higher frequency AC has a higher frequency than the basic sine wave of the second AC current.

In describing the exemplary embodiments shown in the drawings, specific terminology is employed for the sake of clarity. However, the present disclosure is not intended to be limited to the specific terminology so selected and it is to be understood that each specific element includes all technical equivalents that operate in a similar manner.

Figure 7:
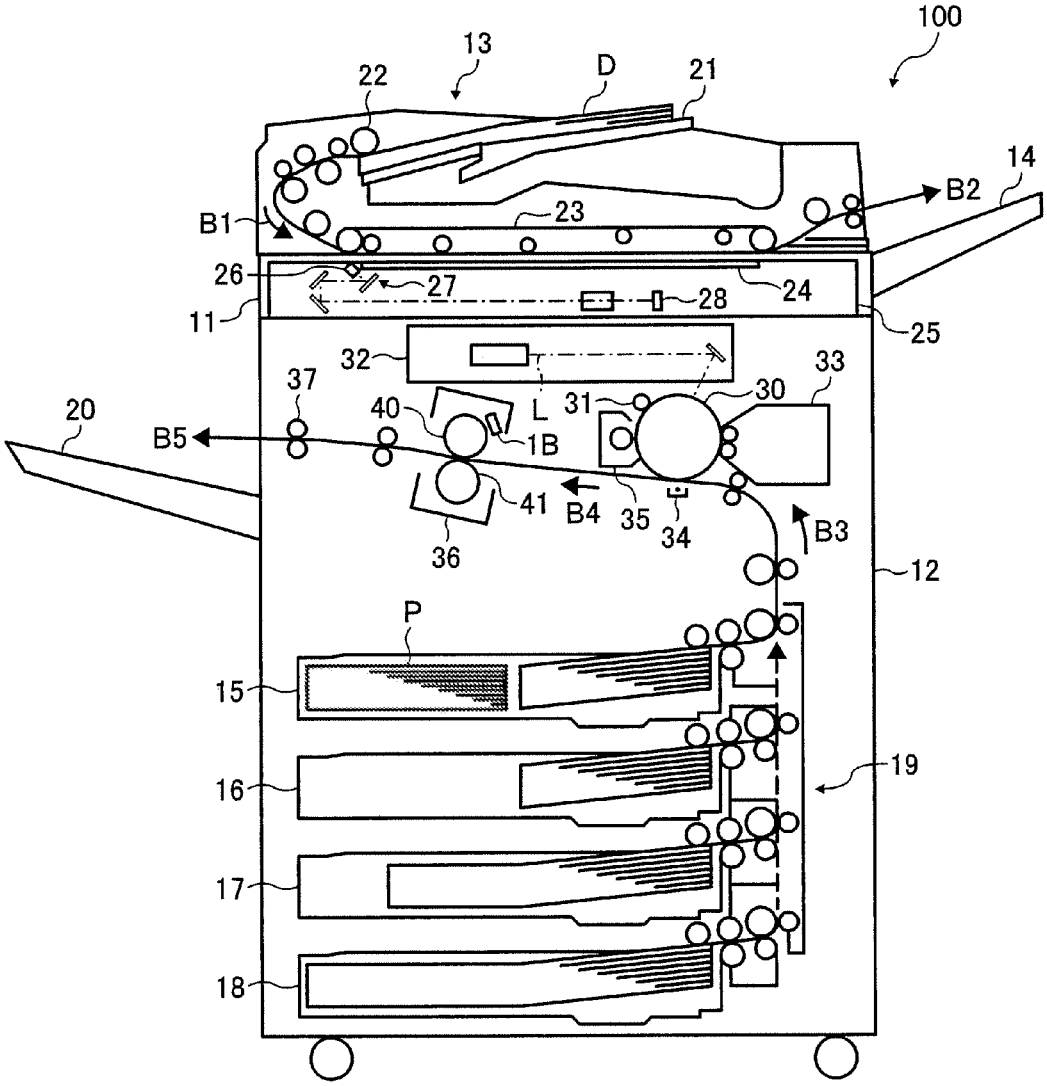
FIG. 7 shows a schematic cross-sectional view of an image forming apparatus 100 according to an exemplary embodiment of the present invention.

Referring now to the drawings, wherein like reference numerals designate identical or corresponding parts throughout the several views, a unit or method for induction-heating according to an exemplary embodiment is described with particular references to FIG. 7 and other drawings.

Hereinafter, an image forming apparatus according to an exemplary embodiment is explained.

FIG. 7 shows a schematic cross-sectional view of an image forming apparatus 100 according to an exemplary embodiment. The image forming apparatus 100 may use electrophotography for forming an image on a recording medium, for example.

The image forming apparatus 100 may employ an induction-heating fixing unit having a boosting unit and a power-supply unit according to an exemplary embodiment.

As shown in FIG. 7, the image forming apparatus 100 may include a scanning unit 11, an image forming unit 12, an automatic document feeder (ADF) 13, a document ejection tray 14, and a sheet ejection tray 20, for example.

The scanning unit 11 may scan documents fed by the automatic document feeder (ADF) 13. The document ejection tray 14 may receive and stack documents fed by the ADF 13.

The sheet feed section 19 may include sheet cassettes 15, 16, 17, and 18. The sheet ejection tray 20 may stack recording medium (e.g., paper) ejected from the image forming unit 12.

A user may set a document D on a document receiver 21 of the ADF 13.

The user may press a print key on an operation key unit (not shown) to feed the document D in a direction shown by an arrow B1 so that the document D may be fed on a contact glass 24 of the scanning unit 11.

Specifically, a pickup roller 22 and a document transport belt 23 may rotate to feed the document D to the contact glass 24 of the scanning unit 11.

A scanner 25, provided under the contact glass 24, may scan an image of document D placed on the contact glass 24.

As shown in FIG. 7, the scanner 25 may include a light source 26, an optical device 27, and a photoelectric transducer 28, for example.

The light source 26 may irradiate the document D placed on the contact glass 24. The optical device 27 may focus a document image to the photoelectric transducer 28. For example, the photoelectric transducer 28 may include a charge coupled device (CCD), to which a document image may be focused.

After scanning an image with the scanner 25, the document D may be transported in a direction shown by an arrow B2 with a rotation of the document transport belt 23, and may be ejected to the document ejection tray 14.

As such, the document D may be fed to the contact glass 24 one by one, and the scanning unit 11 may scan a document image one by one.

The image forming unit 12 may include a photoconductor 30 as an image carrier, and a writing unit 32, for example.

The photoconductor 30 may rotate in a clockwise direction, and a surface of the photoconductor 30 may be charged to a given voltage by a charging unit 31.

The writing unit 32 may irradiate a modulated light beam L, generated based on an image information scanned by the scanner 25, to a charged surface of the photoconductor 30 to form an electrostatic latent image on the surface of the photoconductor 30.

The electrostatic latent image may be developed as a visible image (e.g., toner image) by a developing unit 33.

Then, the visible image may be transferred to a recording medium P from the photoconductor 30 with an effect of a transfer unit 34.

After transferring the visible image to the recording medium P, a cleaning unit 35 may clean the surface of photoconductor 30.

The image forming unit 12 may include a plurality of sheet cassettes 15 to 18 in a lower portion of the image forming unit 12. Each of the sheet cassettes 15 to 18 may contain recording medium P (e.g., paper).

The recording medium P may be fed in a direction shown by an arrow B3 from any one of the sheet cassettes 15 to 18. Then, the recording medium P may be transferred with the visible image from the photoconductor 30 as explained above.

The recording medium P may be further transported in a direction shown by an arrow B4 to a fixing unit 36, which may include a fixing roller 40 and a pressure roller 41.

The fixing roller 40 (as a heating roller) and pressure roller 41 may apply heat and pressure to the recording medium P to fix the visible image on a surface of the recording medium P.

After fixing the visible image on the recording medium P, an ejection roller 37 may transport the recording medium P in a direction shown by an arrow B5 to eject and stack the recording medium P on the sheet ejection tray 20.

The fixing unit 36, configured with the fixing roller 40 and pressure roller 41, may include an IH unit (induction-heating unit) 1B, which may heat the fixing roller 40 with an induction-heating method.

The fixing roller 40 may include a metal core and a surface layer coated on the metal core.

For example, the metal core may be made of magnetic metal material such as iron, cobalt, nickel, or an alloy of such metals, and may be shaped in a hollow cylinder shape.

The metal core of the fixing roller 40 may be preferably made of magnetic metal material having a lower heat capacity (i.e., a temperature of metal can be increased in a shorter period of time).

The surface layer of the fixing roller 40 may be made of a rubber material having a given heat resistance such as silicone rubber. Such rubber material may be solid-type or foamed-type, for example.

The pressure roller 41 may include a metal core and an elastic member coated on the metal core.

For example, the metal core may be made of a metal material having higher heat conductivity such as copper and aluminum, and may be shaped in a cylinder shape. The metal core may be preferably made of a metal including stainless steel, for example.

The elastic member may be made of material having a given heat resistance and higher toner separation ability.

The fixing roller 40 and pressure roller 41 may define a nip therebetween, at which the fixing roller 40 and pressure roller 41 may apply heat and pressure to the recording medium P having an un-fixed toner image thereon.

Figure 8:
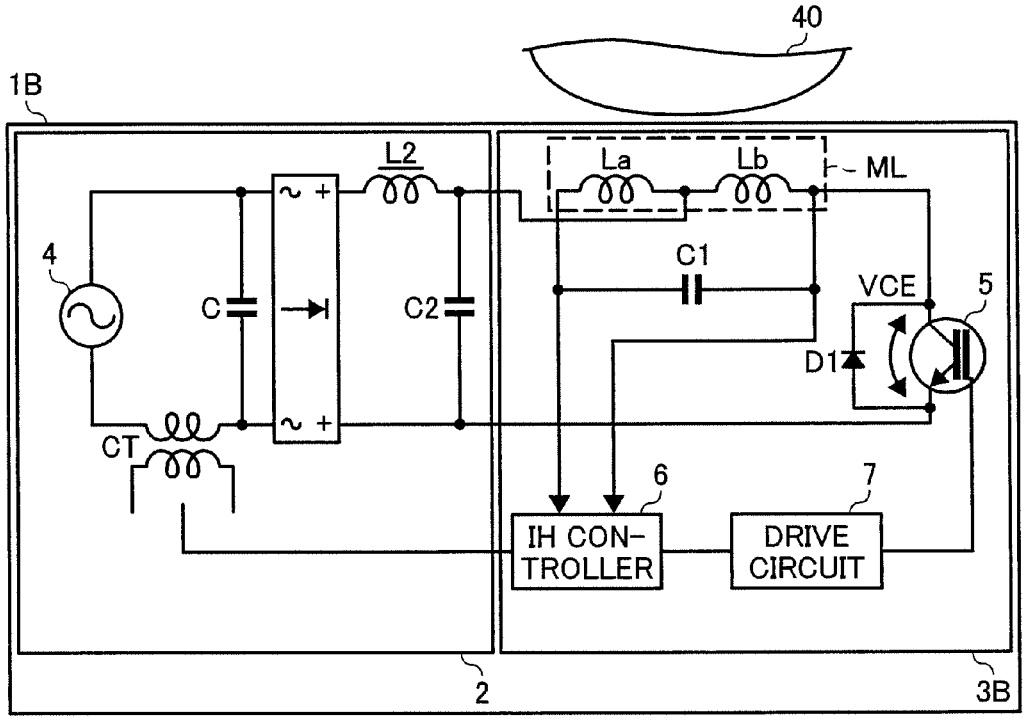
FIG. 8 shows an example circuit diagram of an induction heating unit according to an exemplary embodiment of the present invention.

FIG. 8 shows an example circuit diagram of the IH unit 1B shown in FIG. 7. The IH unit 1B may include a rectifying circuit 2, and an inverter circuit 3B, for example.

As shown in FIGS. 7 and 8, the IH unit 1B may be provided in the fixing unit 36 while setting a given gap between the IH unit 1B and the fixing roller 40, wherein the fixing roller 40 may be an object to be heated by the IH unit 1B.

As shown in FIG. 8, the rectifying circuit 2 may include an initial power supply which may be a commercial power supply 4, a smoothing filer coil L2, a noise filer capacitor C, a capacitor C2, and a current trans CT, for example.

The smoothing filer coil L2 and capacitor C2 may configure an LC filter such as low-pass filter.

The commercial power supply 4 may supply a given value of alternating current (AC) to the rectifying circuit 2.

Such a commercial alternating current (AC) may take different values depending on areas or regions. For example, an alternating current (AC) having a voltage of 100V and frequency of 50 Hz/60 Hz may be used in one area.

The rectifying circuit 2 may convert such an alternating current (AC) to a direct current having a given value (e.g., 141V), and supply such a direct current to the inverter circuit 3B.

The current trans CT may detect an electric current (e.g., AC 100V) of the commercial power supply 4. If the current trans CT detects an error (or abnormal) condition of the electric current of the commercial power supply 4, a protection circuit may be activated.

As shown in FIG. 8, the inverter circuit 3B may include a coupling coil ML, a resonance capacitor C1, an IGBT 5, a body diode D1, an induction-heating controller (IH controller) 6, and a drive circuit 7, for example.

The coupling coil ML may be configured with a heating coil and a resonance coil, cumulatively connected to each other.

The coupling coil ML and the resonance capacitor C1 may be connected in a parallel manner.

The IGBT 5 may be used as a switching device (or element), and may be provided with the body diode D1.

The IH controller 6 may include a microcomputer having a CPU (central processing unit), a ROM (read only memory), and RAM (random access memory), for example.

As shown in FIG. 8, the coupling coil ML may include a first coil La and a second coil Lb, cumulatively connected to each other.

At least one of the first coil La and second coil Lb may be used for heating an object (e.g., fixing roller 40), and the first coil La and second coil Lb may be collectively used as a resonance coil.

The resonance capacitor C1 may have resonance energy when the IGBT 5 conducts a switching operation, wherein the resonance energy may be computed as below.

$$(1/2)Li^2=(1/2)CV^2$$

in which "L" represents inductance of a coil, "i" represents electric current, "C" represents capacitance of a capacitor, and "V" represents voltage.

The IGBT 5 may be used as a switching device (or element), which may convert a direct current to an alternating current having a quasi-higher frequency wave than the second AC supplied by a commercial power supply 4.

Figure 4:
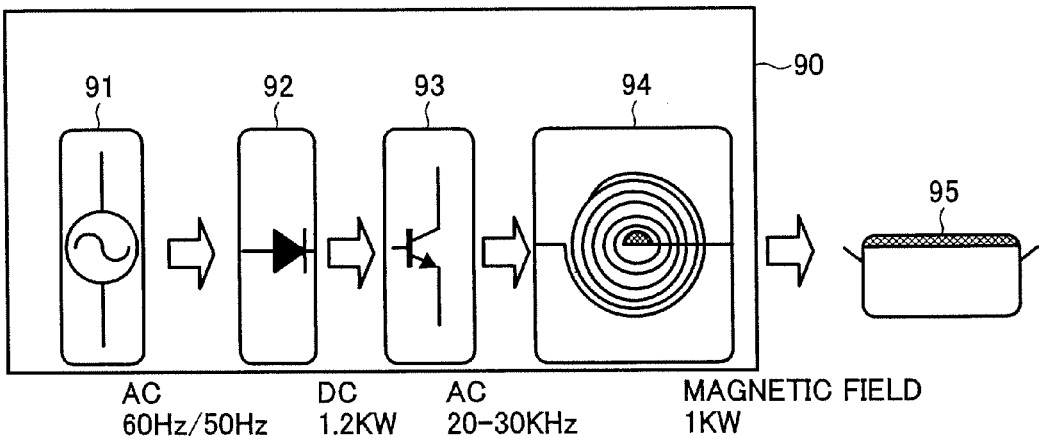
FIG. 4 shows an example block diagram explaining a functional configuration of an induction heating unit.
Figure 5:
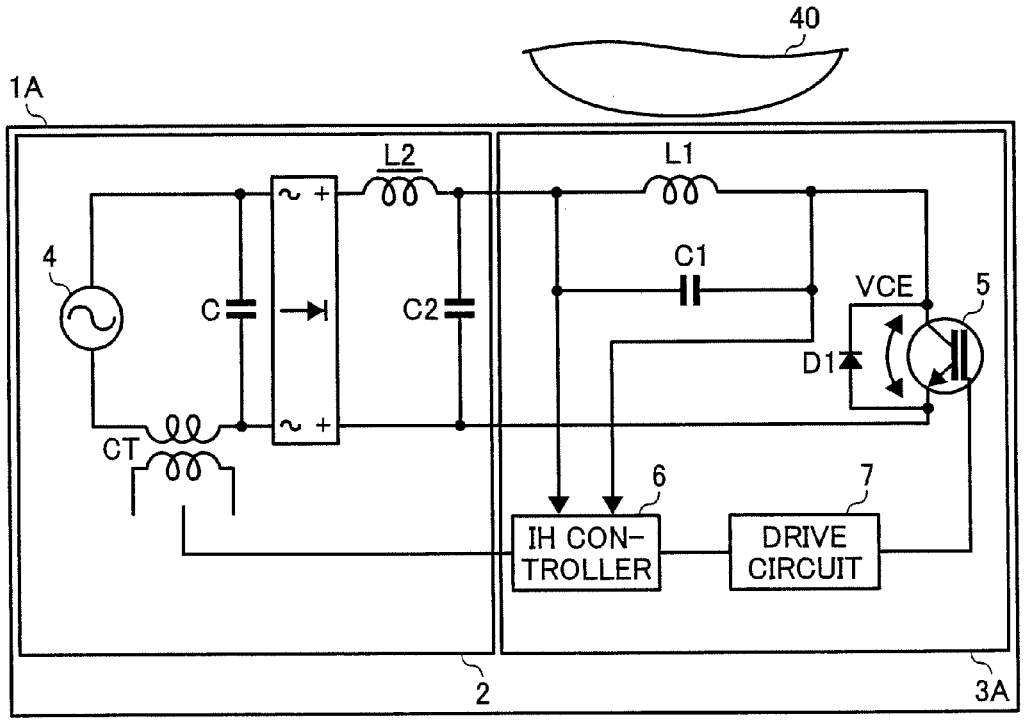
FIG. 5 shows a block diagram of an induction heating unit having a conventional configuration.
Figure 6:
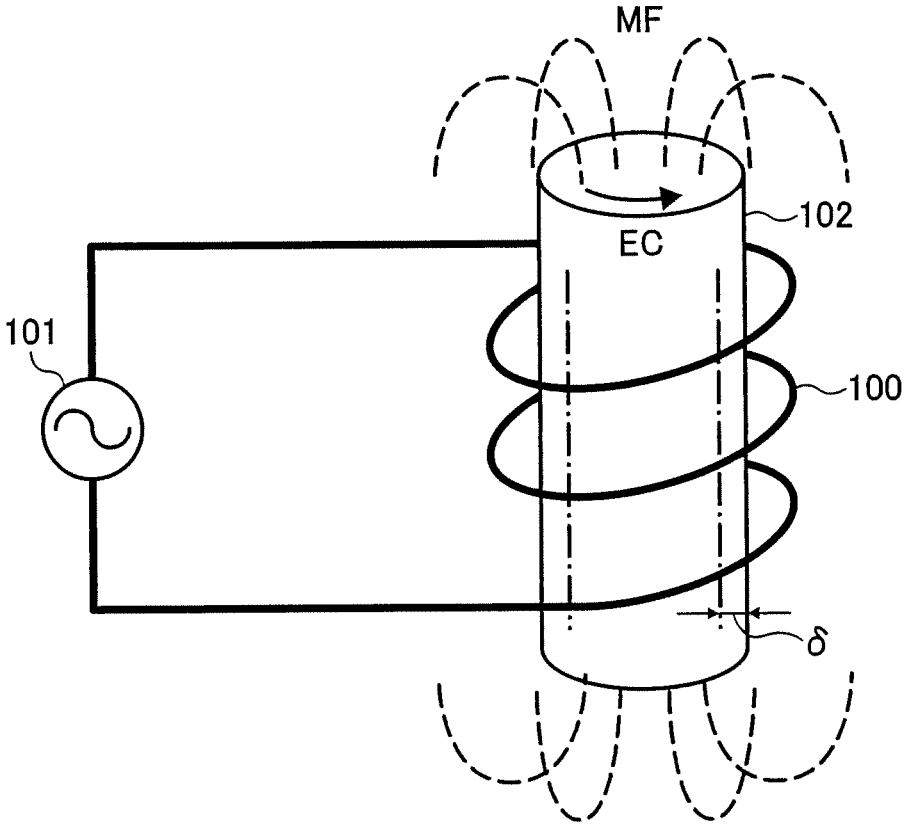
FIG. 6 shows the fundamentals of an induction heating method.

An example of the second AC is shown in FIG. 4 as a commercial alternating current having a frequency of 50 or 60 Hz. However, an IH heater may need an AC current having a higher frequency to effectively heat an object. Such a higher frequency AC current may be obtained by converting the AC supplied, for example, by a commercial power supply, such as the commercial power supply 4 shown in FIG. 8, to DC current, and then to the quasi-higher frequency AC current. Such a quasi-higher frequency AC current may have a different waveform compared to the original waveform of the commercial AC, such as a quasi-higher frequency that is needed for induction heating. A person of ordinary skill in the art would understand that an second AC may be an AC other than a commercial AC and may not come from a commercial power supply.

Referring again to FIG. 8, the IH controller 6 may have a function of correcting a variation of inductance of the coupling coil ML.

The IH controller 6 and drive circuit 7 may have a function of controlling a value of quasi-higher frequency wave of the IGBT 5 so that the coupling coil ML may be in a resonance condition.

Although not shown, the IH controller 6 may further include an oscillating circuit (or timer circuit), and a protection circuit, for example. With such a circuit, the IH controller 6 may transmit a given command to the drive circuit 7 to instruct a switching timing of the IGBT 5.

The drive circuit 7 may include a totem-pole circuit, for example. The drive circuit 7 may control an ON/OFF switching of the IGBT 5 based on a given command transmitted from the IH controller 6. Thus, the drive circuit 7 and the IH controller 6 may act as a switchover element to switch the IGBT 5 ON/OFF within a given frequency range from a resonance frequency of the first coil La, second coil Lb, and the resonance capacitor C1.

The inverter circuit 3 may receive a direct current from the rectifying circuit 2, and then convert the direct current to an alternating current having a quasi-higher frequency wave (e.g., 20 KHz to 60 KHz) by using the IGBT 5.

The IH controller 6 and drive circuit 7 may control an ON/OFF switching of the IGBT 5.

Such a quasi-higher frequency wave may be supplied to the coupling coil ML and resonance capacitor C1, by which a magnetic field may be generated by the coupling coil ML and a resonance may be generated by the resonance capacitor C1. With such a coupling coil ML, the fixing roller 40 may be inductively heated.

A resonance circuit configuration shown in FIG. 8 having the coupling coil ML, the resonance capacitor C1, and the IGBT 5 (as a switching device or element) may efficiently heat the fixing roller 40.

In the IH unit 1B, a switching operation of the IGBT 5 may be conducted with a given range of frequency, which may be a given range from a resonance frequency "f", defined by the following formula 1.

$$f=\tfrac{1}{2}\pi\sqrt{(LC)} \qquad \text{(formula 1)}$$

With such a resonance frequency "f," a resonance operation having a preferable Q factor may be conducted, by which a switching operation of the IGBT 5 may be efficiently conducted.

When the IGBT 5 is set to an ON-condition, an electric current may flow in the coupling coil ML, and when the IGBT 5 is set to an OFF-condition, a resonance voltage may be applied to the resonance capacitor C1.

When a current flows in the coupling coil ML, a magnetic field may be generated around the coupling coil ML, and such a magnetic field may induce a flow of an eddy current in the fixing roller 40.

With a combined effect of the eddy current and electric resistance of the fixing roller 40, a power computed by $(i^2)\times(R)$, in which "R" represents resistance and "i" represents current, may be generated, by which a joule heat energy may be generated to the fixing roller 40. Accordingly, the fixing roller 40 may be heated by the IH unit 1B.

The IH unit 1B may include the coupling coil ML as explained above.

As explained above, such a coupling coil ML may include a resonance coil for voltage resonance and a heating coil for heating an object (e.g., fixing roller 40).

Accordingly, the coupling coil ML may have the functions of heating and resonance, which may be different from a smoothing filer coil L2 provided in the rectifying circuit 2, in which an alternating current (e.g., AC 100V) may be rectified.

An induction heating process may be conducted with a given electric power (e.g., AC 100V and 60 Hz or 50 Hz). However, an electric power having a higher voltage and higher frequency may be used for increasing a heating speed rate for induction heating.

For example, an input power having AC 100V and 60 Hz or 50 Hz may be increased to an output power having 600-1000$V_{0-p}$ and 20 kHz to 40 kHz by the inverter circuit 3B.

The inverter circuit 3B may include a voltage-resonant circuit (also referred to as "LC resonance circuit"), configured with the coupling coil ML (having a resonance coil and a heating coil) and resonance capacitor C1.

With such a voltage-resonant circuit (or LC resonance circuit), the inverter circuit 3B may generate a resonance waveform having a voltage value, which is obtained by multiplying a direct current voltage transmitted from the rectifying circuit 2 with the Q factor.

The IH unit 1B according to an exemplary embodiment may include a coil configuration, which may cumulatively connect coils, by which a boosting unit may be manufactured with reduced cost without affecting a resonance frequency or Q factor.

Because the coupling coil ML may have the functions of heating and resonance, an inductance value of the coupling coil ML may not be changed in a greater degree.

A booster circuit according to an exemplary embodiment may increase a voltage used for induction heating without changing the inductance value of the coupling coil ML, and may increase the amount of eddy current flow in the fixing roller 40.

Accordingly, a switching loss of the IGBT 5 may be reduced, and a peak value (or "resonance peak value") of the resonance voltage may be increased.

With such a configuration, a heating time required for heating an object (e.g., fixing roller 40) by the IH unit 1B may be decreased.

The IH unit 1B having the above-explained coil configuration may efficiently warm or heat an object (e.g., fixing roller 40) with a shorter time without changing a resonance frequency.

Hereinafter, a coil configuration having cumulatively connected coils for heating and resonance is explained with reference to FIG. 9.

Figure 9A:
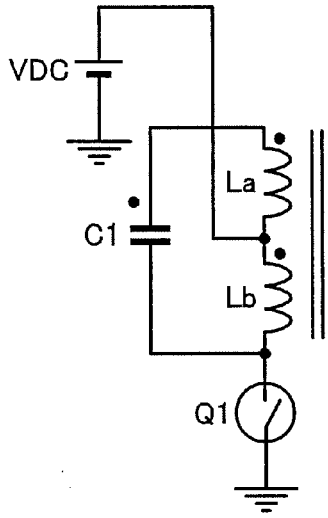
FIG. 9A shows an example circuit diagram having a plurality of cumulatively connected coils.
Figure 9B:
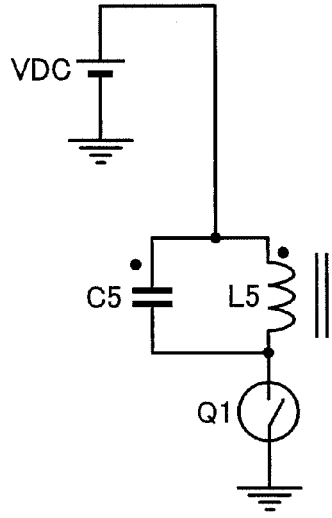
FIG. 9B shows a conventional circuit diagram having a heating coil.

FIGS. 9A and 9B show example circuit diagrams having heating coils and a Q-factor of Q1.

FIG. 9A shows an example circuit diagram having a plurality of coils, cumulatively connected, in which coils may be used for heating an object and for resonance.

FIG. 9B shows a conventional circuit diagram having a heating coil.

In general, heat energy to be generated by a coil may be determined by an induced electromotive force per one winding of the coil.

As for the conventional heating coil shown in FIG. 9B, induced electromotive force "e," winding number "N," inductance "L," magnetic flux "ϕ," and electric current "I" may have following relationships:

$$e=-N(\Delta\phi/\Delta t)$$

$$e=-L(\Delta I/\Delta t)$$

$$L=N(\Delta\phi/\Delta I)$$

Accordingly, an induced electromotive force "e" may proportionally increase with respect to winding number "N" and inductance "L."

Accordingly, in such a conventional heating coil, heat energy to be generated by a heating coil can be increased by increasing an induced electromotive force "e", wherein the induced electromotive force "e" can be increased by increasing a winding number of the coil as above explained.

However, if the winding number of the coil may be changed, an inductance of the coil may also change.

A conventional IH unit may include a resonance circuit shown in FIG. 9B, which may include a heating coil L5 and a capacitor C5. If an inductance of the coil may change in such a circuit, a frequency for the circuit may also change according to the above-mentioned formula 1.

If a frequency for a circuit may be significantly shifted from a resonance frequency, a resonance circuit may not be driven efficiently, and an efficiency of the resonance circuit may be significantly reduced.

FIG. 9A shows a magnetic coupling coil according to an exemplary embodiment, in which the magnetic coupling coil may have a mutual inductance M, and coupling coefficient k. Such a magnetic coupling coil may have an induced electromotive force "e2," expressed by:

$$e2=-M(\Delta I/\Delta t)$$

The mutual inductance M may be determined by the following formula 2, in which an inductance of a first coil La and a second coil Lb may correspond to an inductance L1 and L2, respectively.

$$M=k\sqrt{(L1)\times(L2)} \qquad \text{(formula 2)}$$

Accordingly, the induced electromotive force "e2" for the magnetic coupling coil shown in FIG. 9A may be determined without an effect of the winding number of the coil.

Therefore, the induced electromotive force "e2" for the magnetic coupling coil shown in FIG. 9A may be controlled easily without affecting an efficiency of a resonance circuit.

Furthermore, such a coil configuration shown in FIG. 9A may preferably boost a voltage value based on an inductance ratio of coils of La and Lb without changing an inductance value of each coil.

Accordingly, an induced electromotive force for a resonance circuit may be increased without changing an inductance value of each coil.

Furthermore, because such a coil configuration shown in FIG. 9A may have a simpler configuration compared to an insulating-type transistor, a resonance circuit having the coil configuration shown in FIG. 9A may be manufactured with a reduced cost.

Such a IH unit 1B may heat the fixing roller 40 to a given temperature in a shorter period of time by setting a given value for the Q factor, which may be selectively set by changing a condition of the circuit.

For example, a Q factor of five to seven may be set when a resonance circuit is driven by one electronic element.

The LC resonance circuit may be driven at a higher efficiency when the LC resonance circuit is driven with a given range from a resonance frequency $f_o$, wherein the resonance frequency $f_0$ may be expressed as $f_0=(1/2\pi)\sqrt{LC}$.

Figure 10A:
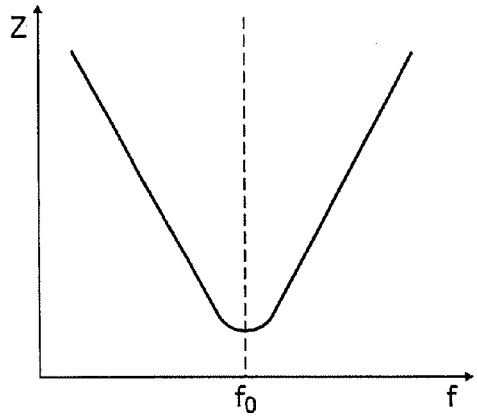
Figure 10B:
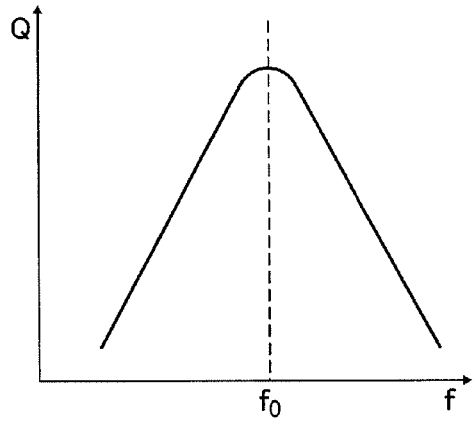

FIGS. 10A and 10B show example waveform charts of a LC resonance circuit. FIG. 10A shows an impedance change of a heating coil with respect to frequency, and FIG. 10B shows a change of Q factor with respect to frequency.

When an LC constant for an LC resonance circuit is set to a given value, a resonance frequency for the LC resonance circuit can be determined with the above-mentioned formula 1. Accordingly, a drive frequency for the LC resonance circuit may be determined.

Furthermore, heat energy to be generated in an object such as a metal object may be determined by a magnetic flux generated around the object. Such a magnetic flux may be determined by an amount of electric current flown in the object, and such an electric current may be determined with a $V_{ce0\text{-}p}$ of IGBT 5 and a resistance value of the object to be heated.

Hereinafter, additional heating coils are explained with reference to FIGS. 11 to 13.

Figure 11:
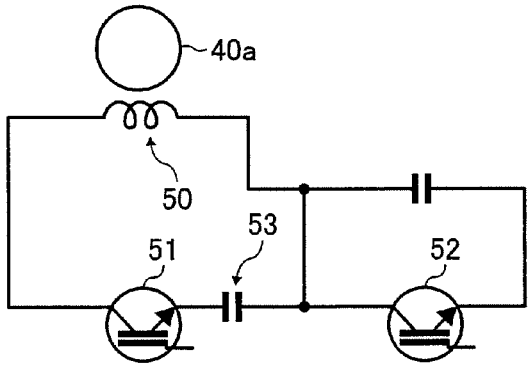
FIGS. 11, 12, and 13 show example circuitry having a heat coil, an IGBT, and a resonance capacitor for heating.

FIG. 11 shows circuitry having a heat coil 50, IGBTs 51 and 52, and a resonance capacitor 53 for heating an object (e.g., fixing roller 40*a*).

Figure 12:
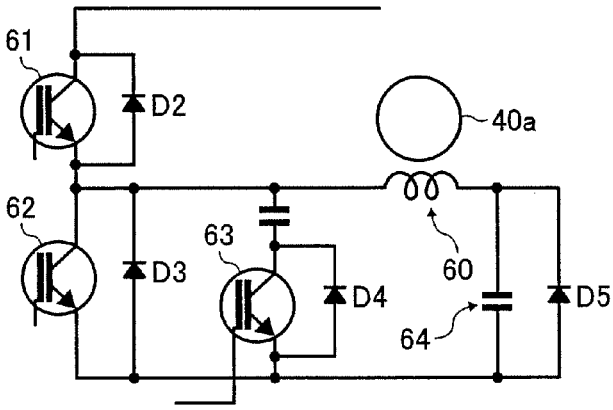

FIG. 12 shows circuitry having a heat coil 60, IGBTs 61, 62, and 63, diodes D2, D3, D4, and D5, and a resonance capacitor 64 for heating an object (e.g., fixing roller 40*a*).

Figure 13:
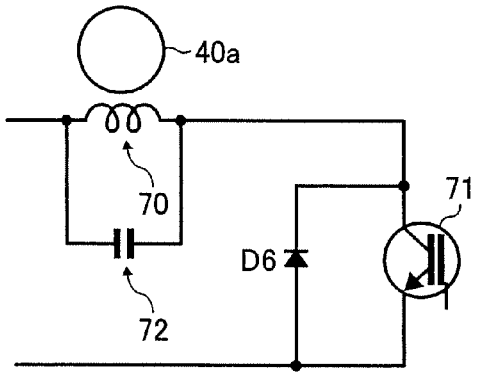

FIG. 13 shows circuitry having a heat coil 70, an IGBT 71, a resonance capacitor 72, and a diode D6 for heating an object (e.g., fixing roller 40*a*).

In each circuit shown in FIGS. 11 to 13, if an inductance L of a heating coil is set to a greater value, or if a capacitance C of a capacitor is set to a smaller value, a Q factor can be increased with a magnetic field generated around a metal cylinder for a heating coil and an eddy current, which may flow in a direction to cancel an effect of the magnetic field.

In the configurations shown in FIG. 11 to FIG. 13, a resonance frequency $f_0$ may be changed by a magnetic field generated by an electric current flowing in the heating coil.

If a switching speed of the IGBT exceeds an upper speed limit under such a condition, a power loss for a switching operation may become greater.

Furthermore, an increase of the Q factor may mean an increasing of a sharpness of a resonance waveform, which may be difficult to control. For example, if a frequency may change under a condition having a sharper resonance waveform, a boosting rate may change greatly.

Furthermore, with a restriction of space, an increase of inductance L of a heating coil may be difficult.

In the configurations shown in FIGS. 11 to 13, a resonance voltage $V_{ce0\text{-}p}$ may be increased without changing the Q factor by biasing a DC bias to a resonance voltage. For example, an electric double layer capacitor may be used.

However, such a method may require a charge/discharge power source for the capacitor in addition to a power source for an IH unit, which may not be preferable from a viewpoint of reducing the manufacturing cost.

Figure 14:
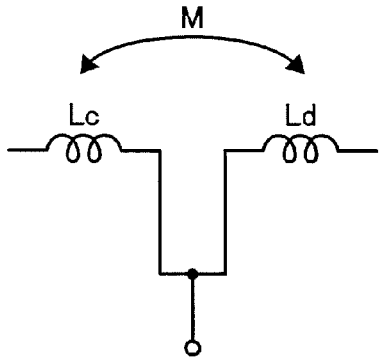
FIG. 14 shows a circuit diagram for a heating coil configured with a plurality of coils cumulatively connected to each other.

FIG. 14 shows a circuit diagram for a heating coil configured with a plurality of coils, cumulatively connected to each other, in which a heat coil Lc and a smoothing filer coil Ld may be cumulatively connected to each other. FIG. 14 also shows a coupling coefficient M.

Figure 15:
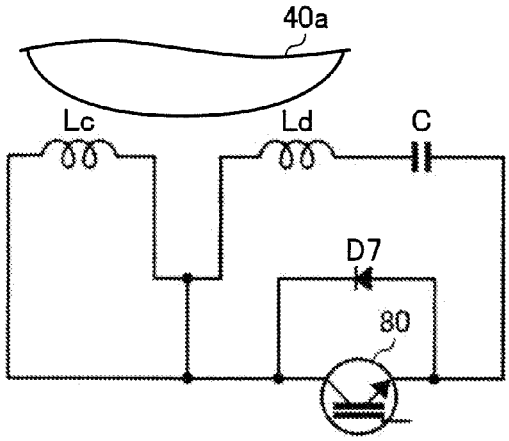
FIGS. 15 and 16 show circuit diagrams for an induction heating unit using a heating coil shown in FIG. 14.
Figure 16:
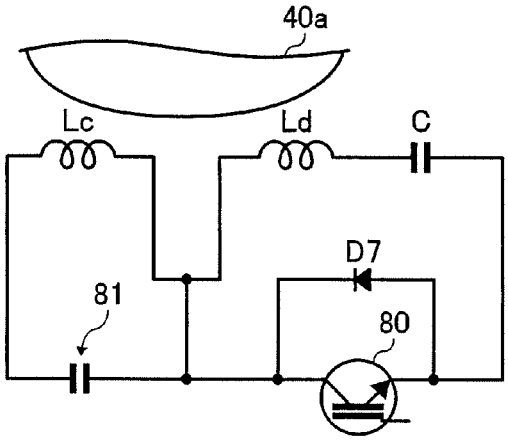

FIGS. 15 and 16 show circuit diagrams for an induction heating unit using the heating coil shown in FIG. 14.

FIG. 15 shows circuitry using the heating coil Lc and smoothing filer coil Ld shown in FIG. 14, cumulatively connected to each other, and an IGBT 80.

FIG. 16 shows circuitry using the heating coil Lc and smoothing filer coil Ld shown in FIG. 14, cumulatively connected to each other, an IGBT 80, and a resonance capacitor 81.

FIGS. 15 and 16 may show circuitry, which may have the following relationships.

$$L0=Lc+Ld+2M$$

$$n=\sqrt{(Ld)/(Lc)} \quad \text{(formula 3)}$$

$$M=\sqrt{(Lc)\times(Ld)} \quad \text{(formula 4)}$$

If an inductance of Ld is set to "1," an inductance of Lc may become "(1/n) 2" according to the formula 3. In such a case, a coupling coefficient M may become "1/n" according to formula 4.

Therefore, if an inductance of Ld is set to "1," an equation of "Lc+Ld+2M=L0" may become "$(1/n)^2+1^2+2\times(1/n)=(1+1/n)^2$."

Therefore, L0 may become $(1+1/n)^2$ when the inductance of Ld is set to "1." Under such a condition, Lc and Ld may be expressed as below.

$$Ld=L0\times 1/(1+1/n)^2$$

$$Lc=L0\times 1/(1+1/n)^2\times(1/n)^2$$

Such a coil configuration may preferably boost a voltage based on an inductance ratio of Lc:Ld without changing an inductance of the coil.

For example, when an inductance of Ld is set to "1" and an inductance of Lc is set to "$(1/n)^2$" as explained above, a voltage can be boosted to a value obtained by multiplying an input voltage with a value of "n," expressed as "$n=\sqrt{(Ld)/(Lc)}$" in formula 3 (e.g., $n=\sqrt{(Ld)/(Lc)}=\sqrt{1/\{(1/n)^2\}}=n$).

The above-explained booster circuit, and power-supply unit according to an exemplary embodiment may be employed for a heating unit used for heating an object.

For example, as explained above, the booster circuit and power-supply unit according to an exemplary embodiment may be employed for an image forming apparatus. In addition, the booster circuit and power-supply unit according to an exemplary embodiment may be employed for a heating unit without limiting their applications.

Numerous additional modifications and variations are possible in light of the teachings herein. It is therefore to be understood that within the scope of the appended claims, the disclosure may be practiced otherwise than as specifically described herein.

What is claimed is:

1. A boosting circuit, comprising:

a switch element that generates a first alternating current voltage having a first frequency from a direct current voltage;

a first coil that generates a magnetic field around the first coil with a flow of the first alternating current voltage having the first frequency in the first coil;

a second coil cumulatively connected in series to the first coil, and the direct current voltage from a rectifying circuit is input at a connection point between the first coil and the second coil, such that the first coil and the second coil have a mutual inductance to induce an eddy current in an object with the magnetic field to inductively heat the object;

a capacitor connected in parallel across the first coil, the second coil, and the connection point between the first coil and the second coil at which the direct current voltage is input; and a controller that controls a switching timing of the switch element based on an electrical measurement made across the circuit formed by the series connected first and second coils connected in parallel to the capacitor to correct a variation of the mutual inductance of the first coil and the second coil.

2. The boosting circuit according to claim 1, wherein the switch element includes an insulated gate bipolar transistor.

3. The boosting circuit according to claim 1, wherein, the controller controls the switching timing of the switch element based on a resonance frequency of the circuit formed by the series connected first and second coils arranged in parallel with the capacitor.

4. A power unit for use in an induction heating unit for heating an object, comprising:

a power source that generates a direct current voltage; and a boosting circuit, including a switch element that generates a first alternating current voltage having a first frequency from a direct current voltage, a first coil that generates a magnetic field around the first coil with a flow of the first alternating current voltage having the first frequency in the first coil, a second coil cumulatively connected in series to the first coil, and the direct current voltage from a rectifying circuit is input at a connection point between the first coil and the second coil, such that the first coil and the second coil have a mutual inductance to induce an eddy current in an object with the magnetic field to inductively heat the object, a capacitor connected in parallel across the first coil, the second coil, and the connection point between the first coil and the second coil at which the direct current voltage is input, and a controller that controls a switching timing of the switch element based on an electrical measurement made across the circuit formed by the series connected first and second coils connected in parallel to the capacitor to correct a variation of the mutual inductance of the first coil and the second coil, wherein the boosting circuit receives the direct current voltage generated by the power source.

5. The power unit of claim 4, wherein the first frequency is higher than a second frequency of a second alternating current voltage rectified by the power source.

6. The power unit of claim 4, wherein a waveform of the first alternating current voltage differs from a waveform of a second alternating current voltage from the power source, the second alternating current voltage has a sinusoidal waveform, and the first alternating current voltage has a rectangular waveform.

7. A power unit for use in an induction heating unit for heating an object, comprising:

a rectifying circuit that rectifies a second alternating current voltage to a direct current voltage; and a boosting circuit, comprising:

a switch element that generates a first alternating current voltage having a first frequency from the direct current voltage, a first coil that generates a magnetic field around the first coil with a flow of the first alternating current voltage having the first frequency in the first coil, a second coil cumulatively connected in series to the first coil, and the direct current voltage from the rectifying circuit is input at a connection point between the first coil and the second coil, such that the first coil and the second coil have a mutual inductance to induce an eddy current in an object with the magnetic field to inductively heat the object, a capacitor connected in parallel across the first coil, the second coil, and the connection point between the first coil and the second coil at which the direct current voltage is input, and a controller that controls a switching timing of the switch element based on an electrical measurement made across the circuit formed by the series connected first and second coils connected in parallel to the capacitor to correct a variation of the mutual inductance of the first coil and the second coil.

8. The power unit of claim 7, wherein the first frequency is higher than a second frequency of the second alternating current voltage.

9. The power unit of claim 7, wherein a waveform of the first alternating current voltage differs from a waveform of the second alternating current voltage, the second alternating current voltage has a sinusoidal waveform, and the first alternating current voltage has a rectangular waveform.

10. An image forming apparatus, comprising:

a fixing member that fixes an un-fixed image, formed of image developer, on a recording medium; and a power unit for use in an induction heating unit for heating the fixing member, including a rectifying circuit that rectifies a second alternating current voltage to a direct current voltage, and a boosting circuit, comprising:

a switch element that generates a first alternating current voltage having a first frequency from the direct current voltage, a first coil that generates a magnetic field around the first coil with a flow of the first alternating current voltage having the first frequency in the first coil, a second coil cumulatively connected in series to the first coil, and the direct current voltage from the rectifying circuit is input at a connection point between the first coil and the second coil, such that the first coil and the second coil have a mutual inductance to induce an eddy current in the fixing member with the magnetic field to inductively heat the fixing member, a capacitor connected in parallel across the first coil, the second coil, and the connection point between the first coil and the second coil at which the direct current voltage is input, and a controller that controls a switching timing of the switch element based on an electrical measurement made across the circuit formed by the series connected first and second coils connected in parallel to the capacitor to correct a variation of the mutual inductance of the first coil and the second coil, wherein the power unit heats the fixing member inductively.

11. An image forming apparatus, comprising:

a fixing member that fixes an un-fixed image, formed of image developer, on a recording medium; and a power unit for use in an induction heating unit for heating the fixing member, including a power source that generates a direct current voltage; and a boosting circuit, comprising:

a switch element that generates a first alternating current voltage having a first frequency from a direct current voltage, a first coil that generates a magnetic field around the first coil with a flow of the first alternating current voltage having the first frequency in the first coil, a second coil cumulatively connected in series to the first coil, and the direct current voltage from a rectifying circuit is input at a connection point between the first coil and the second coil, such that the first coil and the second coil have a mutual inductance to induce an eddy current in an object with the magnetic field to inductively heat the fixing member, a capacitor connected in parallel across the first coil, the second coil, and the connection point between the first coil and the second coil at which the direct current voltage is input, and a controller that controls a switching timing of the switch element based on an electrical measurement made across the circuit formed by the series connected first and second coils connected in parallel to the capacitor to correct a variation of the mutual inductance of the first coil and the second coil, wherein the boosting circuit receives the direct current voltage generated by the power source, wherein the power unit heats the fixing member inductively.

* * * * *